US007992399B2

(12) United States Patent
Monk et al.

(10) Patent No.: US 7,992,399 B2
(45) Date of Patent: Aug. 9, 2011

(54) PRESSURE EQUALIZATION COMPONENT FOR A COMPRESSOR

(75) Inventors: David T. Monk, Bristol, VA (US); Richard C. Denzau, Abingdon, VA (US); John Robert Williams, Bristol, VA (US); Scott G. Hix, Bristol, VA (US); Timothy Michael Wampler, Bluff City, TN (US); Bruce Moody, Kingsport, TN (US)

(73) Assignee: Bristol Compressors International, Inc., Bristol, VA (US)

( * ) Notice: Subject to any disclaimer, the term of this patent is extended or adjusted under 35 U.S.C. 154(b) by 669 days.

(21) Appl. No.: 12/044,953

(22) Filed: Mar. 8, 2008

(65) Prior Publication Data

US 2008/0216499 A1 Sep. 11, 2008

Related U.S. Application Data

(60) Provisional application No. 60/893,678, filed on Mar. 8, 2007.

(51) Int. Cl.
*F25B 49/00* (2006.01)

(52) U.S. Cl. ..... 62/228.5

(58) Field of Classification Search ..... 62/196.3, 62/228.5, 228.1; 417/299, 435, 440; 418/14, 418/201.2

See application file for complete search history.

(56) References Cited

U.S. PATENT DOCUMENTS

| | | | | |
|---|---|---|---|---|
| 2,314,591 | A * | 3/1943 | McCormack | 62/196.3 |
| 3,626,979 | A * | 12/1971 | Abell | 137/528 |
| 5,403,168 | A * | 4/1995 | Evenson | 417/536 |
| 5,910,166 | A * | 6/1999 | Mitchell et al. | 62/511 |
| 6,584,791 | B2 | 7/2003 | Monk et al. | |
| 6,823,686 | B2 | 11/2004 | Chumley et al. | |
| 2005/0066673 | A1 * | 3/2005 | Monk et al. | 62/196.3 |

* cited by examiner

*Primary Examiner* — Melvin Jones
(74) *Attorney, Agent, or Firm* — McNees Wallace & Nurick LLC

(57) ABSTRACT

A system to equalize pressure connected to a compressor for use in HVAC&R system is provided. The system includes a component in fluid communication between a high pressure side and an intermediate pressure side of the compressor. The component is configured to permit flow of refrigerant between the high pressure side and the intermediate pressure side at least when the compressor is not in operation.

20 Claims, 8 Drawing Sheets

PRESSURE EQUALIZATION COMPONENT FOR A COMPRESSOR

CROSS-REFERENCE TO RELATED APPLICATIONS

This application claims the benefit of U.S. Provisional Application No. 60/893,678, entitled PRESSURE EQUALIZATION SYSTEM, filed Mar. 8, 2007, which is hereby incorporated by reference.

BACKGROUND

The present application relates generally to compressors, including those used in heating, ventilation, air conditioning and refrigeration ("HVAC&R") applications. More particularly, the present application relates to a pressure equalization system for starting a compressor, such as a scroll, rotary, or reciprocating compressor, while maintaining the condenser at a high pressure.

A standard HVAC&R system includes a fluid, an evaporator, a compressor, a condenser, and an expansion valve. In a typical refrigeration cycle, the refrigerant fluid begins in a liquid state under low pressure. The evaporator evaporates the low pressure liquid as the liquid absorbs heat from the evaporator, which raises the ambient temperature of the liquid and causes the liquid to undergo a phase change to a low pressure gas. The compressor draws the gas in and compresses it, producing a high pressure gas. The compressor then passes the high pressure gas to the condenser. The condenser condenses the high pressure gas to release heat to the condenser and the gas undergoes a phase change to a high pressure liquid. The cycle is completed when the expansion valve expands the high pressure liquid, resulting in a low pressure liquid. By means of example only, the refrigerant fluid used in the system might be ammonia, ethyl chloride, CFCs, HFCs, Freon®, or other known refrigerants.

Typically, upon start up of a compressor, the pressure at both the suction port and the discharge port of the compressor is low. In operation, the compressor works the fluid to achieve a high pressure at the discharge port. However, when the compressor is no longer operating, the fluid on the high pressure side of the compressor (toward the condenser) flows back toward the low pressure side of the compressor (toward the evaporator) until a state of equilibrium between the formerly high and formerly low pressure sides is achieved. Thus, the pressure tends to equalize between the low pressure side and the high pressure side when the compressor stops operating. Such a system is inefficient because the refrigeration cycle requires energy at start up to create a high pressure in the condenser, which is needed to condense the fluid.

Another problem, specific to HVAC&R systems, is that it is difficult to efficiently achieve the high pressure start up, i.e., a start up where the pressures have not equalized, necessitated by seasonal energy efficiency requirements (SEER), a system used to rate HVAC&R systems. Start up components, such as a start capacitor and a start relay, are commonly used to overcome the differential pressure when the compressor needs to start with the unbalanced pressure in the system, i.e., the high pressure side of the system has a high pressure and the low pressure side of the system has a low pressure. These components achieve a high pressure differential start when the system is activated. These components are rather expensive, however, and they produce high voltages and currents in the compressor motor upon start up.

Therefore what is needed is a system and method for equalizing the pressure in the compressor in order to start the compressor while maintaining a high pressure in the condenser and the high pressure portion of the system.

SUMMARY

As explained in more detail below, the system and method of the present application maintain a high pressure from a valve near the compressor discharge downstream to a condenser, but permit the pressure upstream of the valve to leak back toward a region of intermediate pressure until the pressure upstream of the valve has equalized with the intermediate pressure side of the compressor. This intermediate pressure region is the cylinder bore on both reciprocating and rotary compressor designs and anywhere between start and end angles on scroll compressors. All compressor types have some pressure region during the compression stroke between high and low pressure, the "between" pressure being defined as an intermediate pressure. By maintaining the high pressure downstream from the valve and equalizing the pressure upstream from the valve, expensive and potentially dangerous start up components are significantly reduced. A benefit specific to HVAC&R systems is that the SEER rating of the system is not sacrificed.

In addition, by virtue of leakage upstream of the valve being between high pressure and intermediate pressure regions while the compressor is operating, the difference therebetween being less than between high pressure and low pressure, refrigerant flow leakage between high and intermediate pressure regions is reduced, thereby increasing operational efficiency. In addition, due to pressure fluctuations in the region of intermediate pressure, i.e., the position of the compression stroke, such leakage flow is choked, resulting in further increases in operational efficiency.

The present application is directed to a system to equalize pressure connected to a compressor for use in an HVAC&R system. The system includes a component in fluid communication between a high pressure side and an intermediate pressure side of the compressor. The component is configured to permit flow of refrigerant between the high pressure side and the intermediate pressure side at least when the compressor is not in operation.

The present application is also directed to a system to equalize pressure connected to a compressor for use in an HVAC&R system. The system includes a body and a member having an interface therebetween, the body and member in fluid communication between a high pressure side and an intermediate pressure side of the compressor. The body and member are configured to permit flow of refrigerant between the high pressure side and the intermediate pressure side at least when the compressor is not in operation.

Other features and advantages of the present application will be apparent from the following more detailed description of the embodiments, taken in conjunction with the accompanying drawings which illustrate, by way of example, the principles of the application.

BRIEF DESCRIPTION OF THE DRAWINGS

The accompanying drawings, which are incorporated in and constitute a part of this specification, illustrate several embodiments of the application. Together with the description, these drawings serve to explain the principles of the application.

Wherever possible, the same reference numbers will be used throughout the drawings to refer to the same or like parts.

DETAILED DESCRIPTION

A method and a system for equalizing the pressure in a compressor is provided to permit a startup of the compressor while maintaining a high pressure in portions of the system. It is contemplated that the compressor may be a component of a climate control system, including an HVAC&R system. However, its use is not limited to such systems as the pressure equalization system may be used in any system utilizing a compressor.

Figure 1:
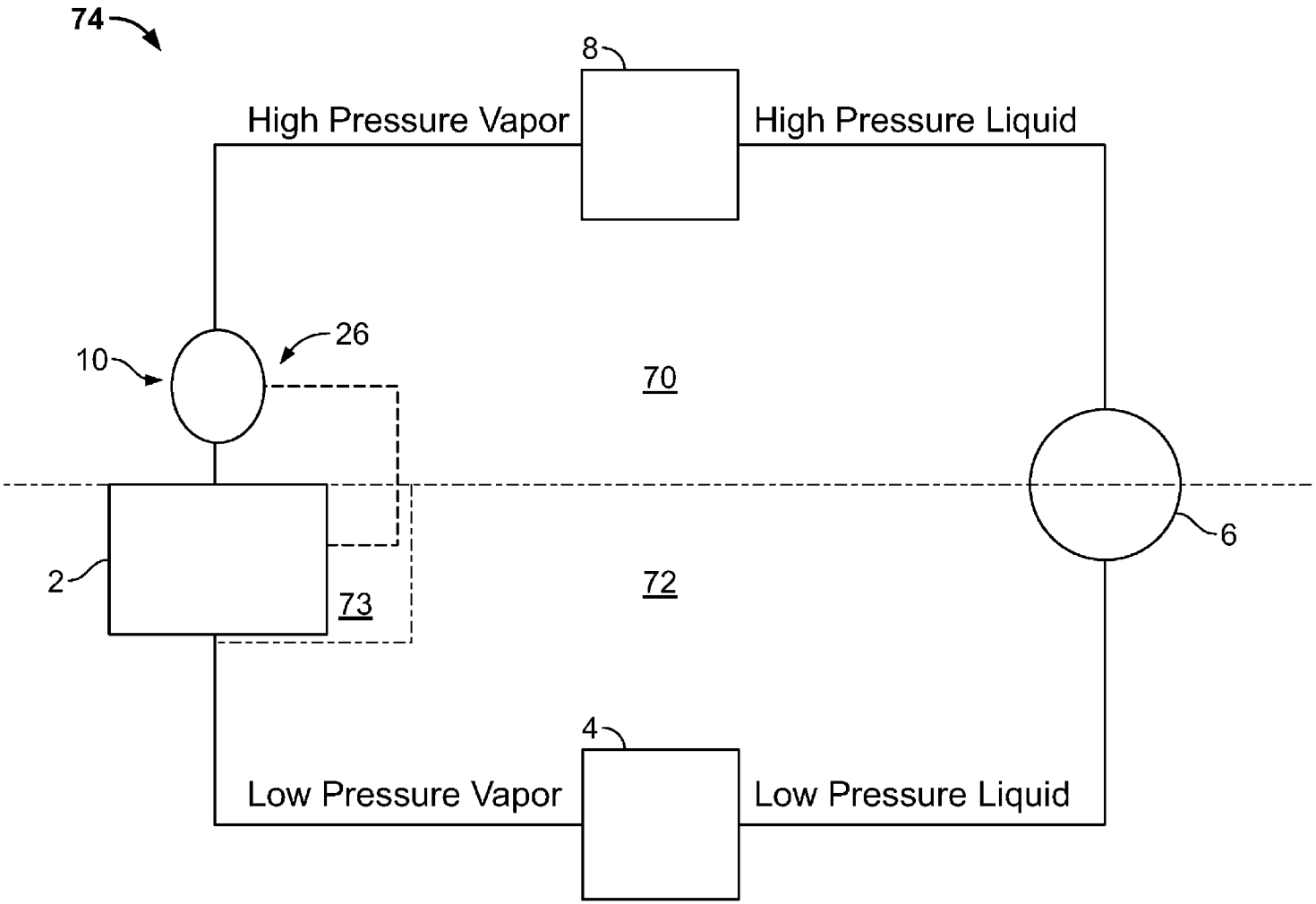
FIG. 1 is a block diagram of an HVAC&R system schematically illustrating a pressure equalization system and method.

An exemplary embodiment of a refrigeration system, including a compressor with a pressure equalization system according to the present application, is illustrated in FIG. 1 and is designated generally as reference number 74.

In an HVAC&R system 74, typically a fluid or refrigerant flows through the system and heat is transferred from and to the fluid. When refrigeration system 74 is turned on, fluid in a liquid state under low pressure is evaporated in an evaporator 4 as the fluid absorbs heat from the evaporator, which raises the ambient temperature of the fluid and results in fluid in a low pressure vapor state. A compressor 2 draws away fluid at a low pressure vapor state and compresses it. Then, fluid at a high pressure vapor state flows to a condenser 8. Condenser 8 condenses the fluid from a high pressure vapor state to a high pressure liquid state. The cycle is completed when an expansion valve 6 expands the fluid from a high pressure liquid state to a low pressure liquid state. The fluid is any available refrigerant, such as, for example, ammonia, ethyl chloride, Freon®, chlorofluocarbons, hydrofluorocarbons, and natural refrigerants.

In conventional systems, when refrigeration system 74 stops operating, the fluid on the high side of compressor 2 at a high pressure vapor state will leak back toward the evaporator 4, and eventually the pressure of the fluid in the compressor 2 will reach a state of equilibrium. When the refrigeration system 74 is placed back into operation, the pressure at the condenser 8 must be brought back up to the pressures prior to the refrigeration system 74 shutting down. In high efficiency systems, start capacitors and start relays are used to restart the compressor 2 and achieve this result when the pressures in the compressor are not equal on startup of the compressor. These components are expensive and produce high voltages and currents in the compressor 2 upon start up. Pressure equalization system 10 overcomes the need for such components in high efficiency systems and the problems and expenses associated with conventional systems, as described in more detail below.

Figure 2:
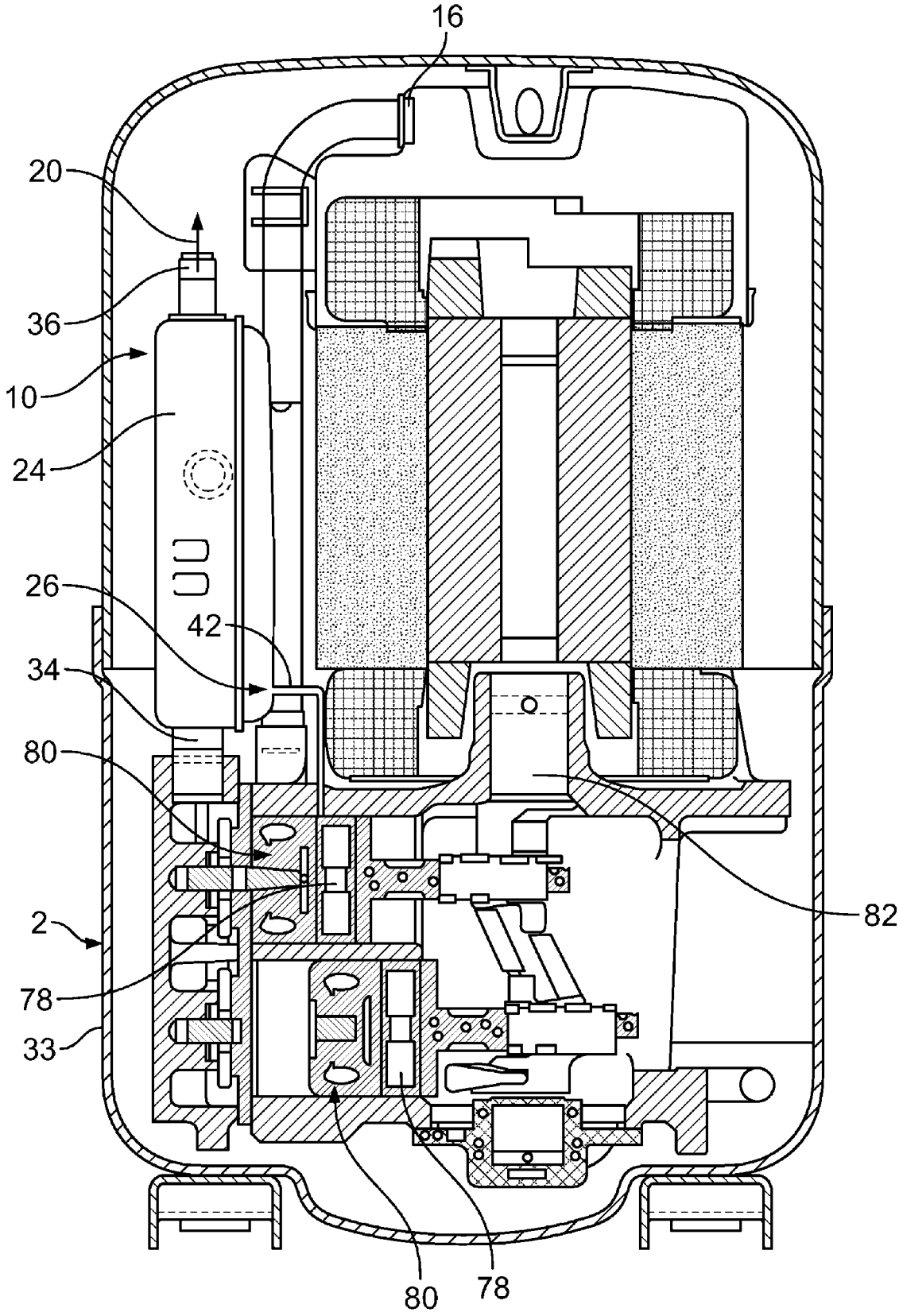
FIG. 2 is a cross-sectional view of an embodiment of a compressor including an internal pressure equalization system.
Figure 3:
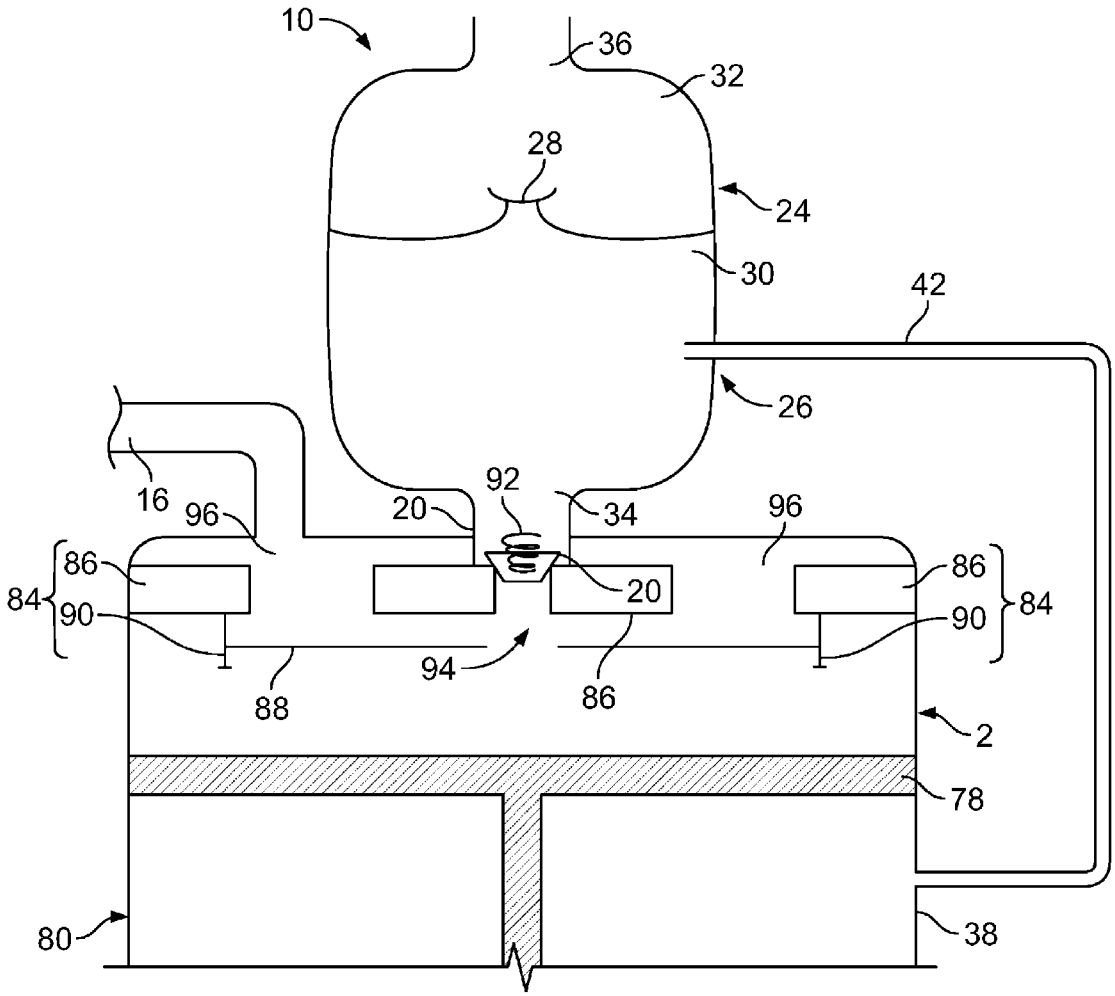
FIG. 3 is a cross-sectional view of an embodiment of a pressure equalization system attached externally to a compressor.

The general components of a reciprocating compressor 2 are illustrated in FIGS. 2 and 3. The components may include compressor housing 38 that houses a shaft 82 that rotates and causes one or more pistons 78 to move within one or more compression chambers 80. The fluid, described above with respect to the schematic in FIG. 1, is drawn at a low pressure into a compressor inlet 16 (or suction line) and into compression chamber 80. For the purposes of the present application, the compressor inlet 16 can be any point in the fluid flow channel extending from the evaporator 4 to, but not including, the compression chambers 80. Piston 78 is operable to move within compression chamber 80 to compress the fluid, which exits compressor 2 at a high pressure through a compressor outlet 20 (or discharge). All compressor types have some pressure region during the compression stroke between high and low pressure, the "between" pressure being defined as intermediate pressure. This intermediate pressure region is the cylinder bore on both reciprocating and rotary compressor designs and anywhere between start and end angles on scroll compressors. Thus, for purposes of the present application, compression chamber 80 is defined as intermediate pressure 73 (FIG. 1) or intermediate pressure side. Also for the purposes of the present application, the compressor outlet 20 can be any point in the fluid flow channel downstream from the compression chamber 80 to the condenser 8.

A compressor typically includes a valve system 84, such as the system exemplified in FIG. 3, to prevent the fluid from flowing back toward compressor inlet 16 when the compressor is operating. Such systems are known to those skilled in the art, and the system depicted in FIG. 3 is illustrative only and in no way limits the claimed embodiments. The illustrated valve system 84 includes a valve plate 86 disposed within compressor housing 38, a valve 92 operably disposed at the compressor outlet 20, and a ring valve 88, defining an aperture 94, slidably disposed on holders 90. Retraction of piston 78 creates a vacuum that draws ring valve 88 away from gaps 96, and draws the fluid into compression chamber 80 through compressor inlet 16. A valve 92 on compressor outlet 20 prevents the fluid from exiting compressor 2 until the fluid reaches a pressure exceeding that beyond valve 92. When piston 78 moves and compresses the fluid to this pressure, the force of the fluid opens valve 92, thereby permitting the high pressure fluid to discharge through compressor outlet 20. During the compression stroke, the force of the fluid moves ring valve 88 towards valve plate 86, blocking gaps 96 and preventing the fluid from escaping through compressor inlet 16.

A pressure equalization system and method is provided to equalize the pressure in the compressor 2, permitting the compressor 2 to start under non-high pressure loading, while maintaining a high pressure in the high pressure portion of the refrigeration system 74. In one embodiment, the pressure equalization system is connected to the compressor 2 and has a valve or a series of valves and a bleed port. The valve or valves maintain high pressure on the high pressure portion of the refrigeration system 74, i.e. the valve(s) maintains a high pressure downstream from the valve to the condenser 8 and the expansion valve 6, when the refrigeration system 74 stops operating. The bleed port permits the pressure in the compressor 2 to reach a state of equilibrium between the high pressure side and the intermediate side of the compressor 2 when the refrigeration system 74 is turned off. The bleed port can be configured to permit little to no fluid to pass through when the system 74 is operating but to permit fluid to leak through when the system is turned off. The pressure equalization system maintains fluid at a high pressure vapor state on the high pressure portion of the refrigeration system 74 while permitting fluid in the compressor 2 to reach a state of equilibrium when the compressor 2 and refrigeration system 74 are turned off. Upon restarting the compressor 2 and refrigeration system 74, it is therefore easier and more efficient to achieve the high pressure state in the high pressure portion of the system 74 because most of the high pressure portion of the system 74 has maintained a high pressure state and has not equalized with the low pressure portion of the system.

Exemplary embodiments of a compressor with a pressure equalization system are illustrated in FIGS. 2 and 3. It is contemplated that pressure equalization system 10 may be located internally within compressor 2, as shown in FIG. 2, or externally as shown in FIGS. 1 and 3. The compressor 2 shown in FIG. 2 is a reciprocating compressor, although the pressure equalization system 10 may be used with any compressor, including, for example, a rotary, screw, or scroll compressor.

As illustrated in FIGS. 2 and 3, compressor outlet 20 is in communication with a housing 24 of pressure equalization system 10, which has a housing inlet 34 and a housing outlet 36. In FIG. 2, housing 24 is located internally within compressor 2, and housing outlet 36 connects to compressor outlet 20. The present application contemplates, however, that housing 24 in FIG. 3 may be positioned externally to compressor 2, such that housing inlet 34 connects to compressor outlet 20. Among other variations, it also has been contemplated that housing inlet 34 could be connected to a cylinder head and housing outlet 36 could be connected to compressor outlet 20.

In the embodiments shown in FIGS. 2 and 3, housing 24 is a muffler or a container structure. Housing 24 also could be a cylinder or any other closed chamber, as described in more detail with respect to FIGS. 5-6. Whether housing 24 is internal or external to compressor 2, the pressure equalization system 10 maintains the fluid at a high pressure vapor state on the high pressure side towards housing outlet 36 while permitting the fluid towards housing inlet 34 to equalize with the fluid in the compression chamber 80 at an intermediate pressure vapor state.

Figure 4:
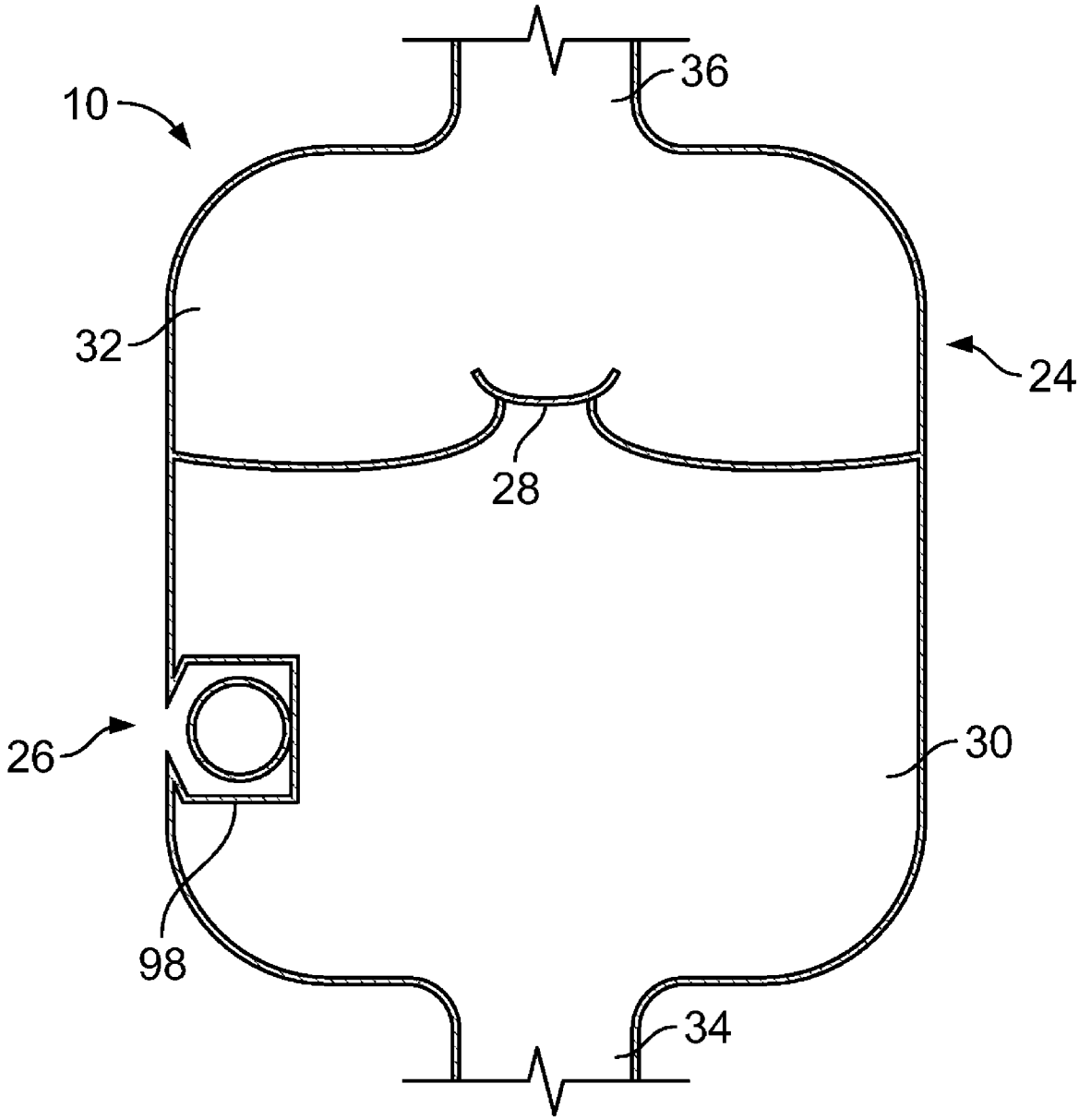
FIG. 4 is a cross-sectional view of an embodiment of a pressure equalization system, including a housing, two valves, and a bleed port.

In a basic embodiment of pressure equalization system 10, shown in FIG. 4, housing 24 has a bleed port 26 and at least one valve 28. Valve 28 divides housing 24 into a first portion 30 and a second portion 32. First portion 30 of housing 24 occupies a space between housing inlet 34 and valve 28, while second portion 32 of housing 24 occupies a space between valve 28 and housing outlet 36. Valve 28 is operably disposed in housing 24 and may be opened or closed. When compressor 2 is on, valve 28 is open and permits the fluid compressed at a high pressure vapor state to flow from first portion 30 of housing 24 to second portion 32 of housing 34. When compressor 2 stops operating, valve 28 closes, preventing backflow of the fluid at a high pressure vapor state into first portion of housing 24. Bleed port 26, located in first portion 30 of housing 24, connects first portion 30 of housing 24 to intermediate pressure side 73 (FIG. 1) of compressor 2 (FIG. 2), such as to compression chamber 80 (FIG. 2), permitting the pressure of the fluid, which is at a high pressure vapor state when the compressor 2 initially is turned off, to equilibrate with the fluid in the compression chamber 80 of compressor 2, which is at an intermediate pressure vapor state. Bleed port 26 (FIG. 2) is connected to the intermediate pressure side of compressor 2 in a sealed manner, for example, through a pipe, tube, or other flow channel, so that the fluid stays within the system 74 (FIG. 1) and does not leak into the atmosphere.

Various embodiments of pressure equalization system 10 are depicted in the figures of Applicant's application Ser. No. 10/967,431 titled "Pressure Equalization System", the contents incorporated by reference in its entirety. However, in each of the embodiments, it is assumed that housing 24 is in communication with compressor 2 as previously described in the present application.

Figure 5:
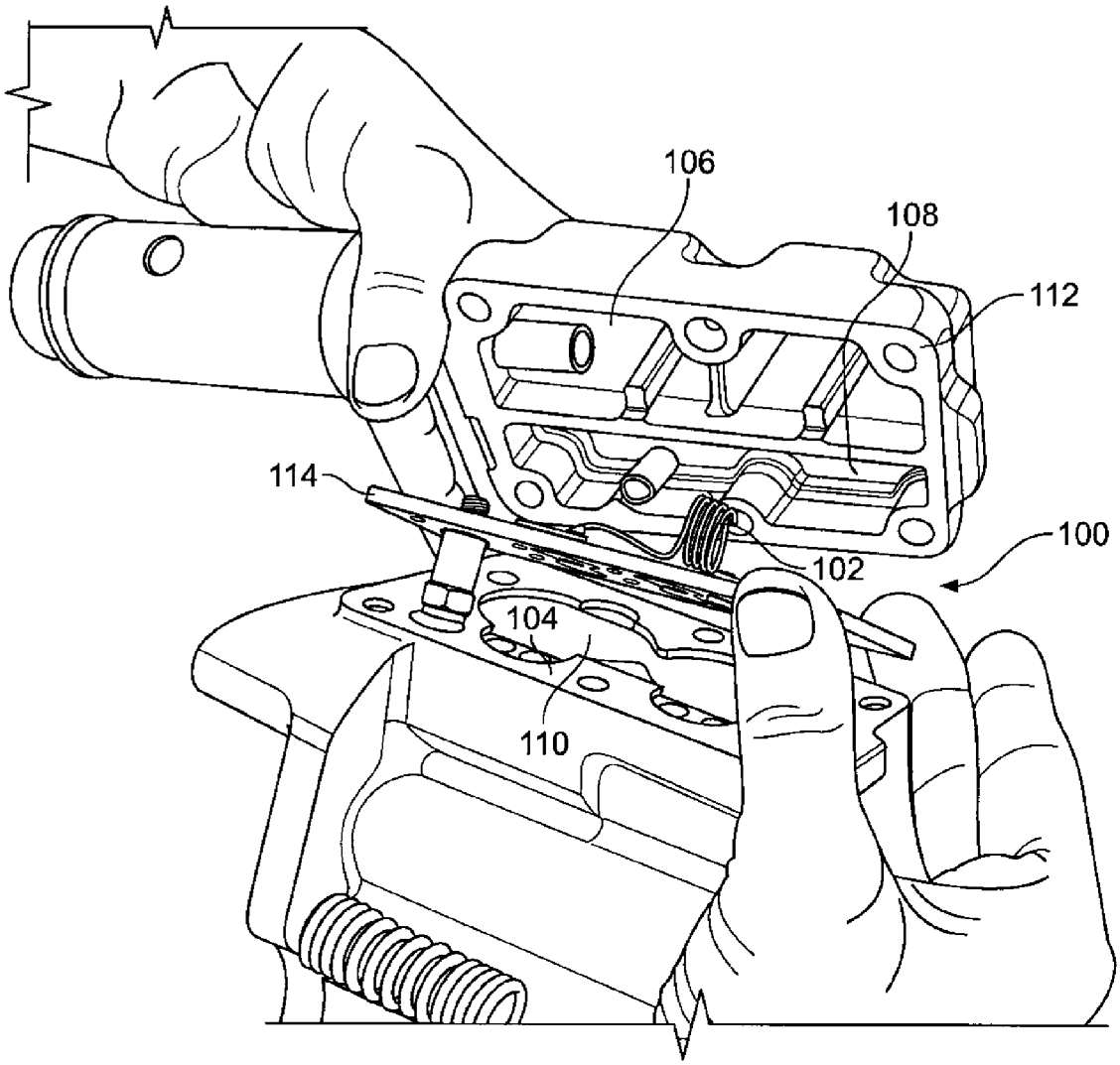
FIGS. 5-6 are various views of an embodiment of a pressure equalization system including a capillary tube disposed in the high pressure side that is in fluid communication with the intermediate pressure side (compression chamber).
Figure 6:
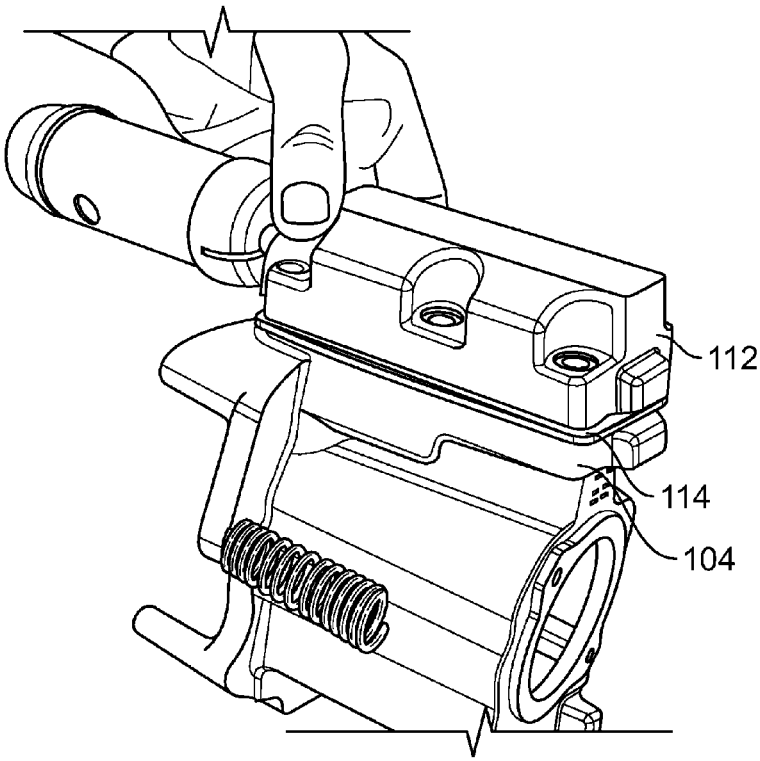

As shown in FIGS. 5-6, an embodiment of a pressure equalization system includes a tube 102, such as a capillary tube, disposed in the high pressure side that is in fluid communication with the intermediate pressure side 110 (compression chamber), in one embodiment of the present application. Although capillary tube 102 is disclosed in one embodiment having an 0.02 inch diameter and a length of 10 inches, other configurations may be used. In an alternate embodiment, tube 102 may include a region of reduced cross section. Alternately, a threaded fastener (not shown) could define a gap forming installation in a threaded aperture formed in a valve plate 114, providing a similar effect, i.e., controlled flow rate between high and intermediate pressure sides 106, 110 of cylinder head 112. The gap forming installation may include cross-threading, as appreciated by one having skill in the art, which refers to a misalignment between a threaded fastener and a mating threaded aperture. Alternately, the gap forming installation may also occur due to mating threaded fasteners with threaded apertures having incompatible thread constructions and/or thread sizes. In addition, forming a groove or slot (not shown) or other irregularity or discontinuity in one or both of the threaded fastener/aperture may similarly form a gap forming installation, i.e., a mating threaded arrangement, or any similar arrangement producing a controlled flow rate between the high and intermediate pressure sides 106, 110.

Figure 7:
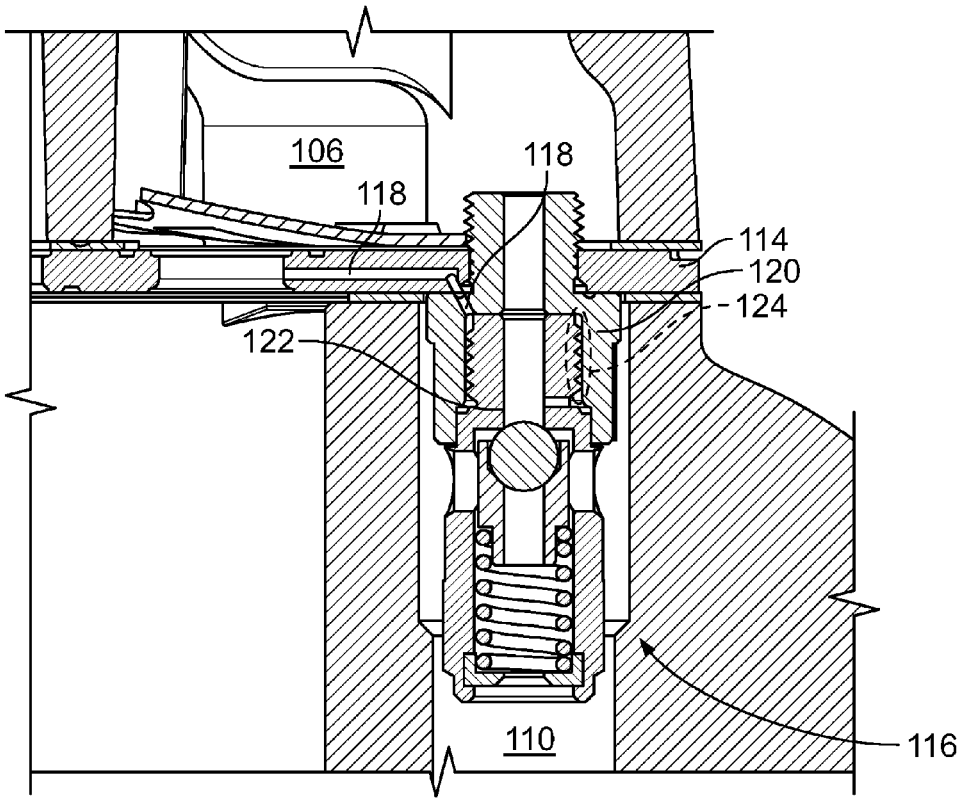
FIGS. 7-9 are various cross sectional views of a pressure equalization system, including a valve disposed in the intermediate pressure side (compression chamber) in fluid communication with the high pressure side.

As shown in FIG. 7, which is a cross sectional view of an embodiment of the pressure equalization system, a safety valve 116 is disposed in the intermediate pressure side 110 (compression chamber) in fluid communication with the high pressure side 106. In addition to serving as a safety valve to bleed refrigerant in response to operating pressures exceeding a predetermined level, safety valve 116 controllably bleeds refrigerant from the high pressure side 106 to the intermediate pressure side 110. High pressure refrigerant flows through a passageway 118 formed in both the valve plate 114 and the first portion 120 to reach the second portion 122. Refrigerant then flows along the interface 124 formed between the first and second portions 120, 122, defining a helical path to reach the intermediate pressure side 110. The cross sectional area along the helical path is sized to provide a desired bleed rate of refrigerant.

Figure 9:
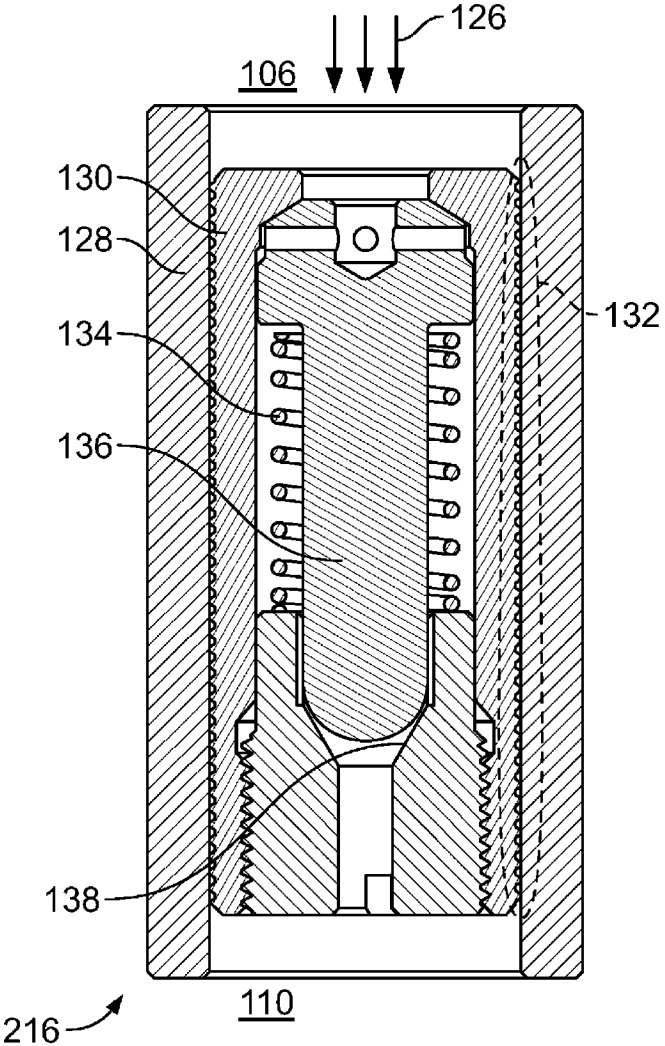
Figure 8:
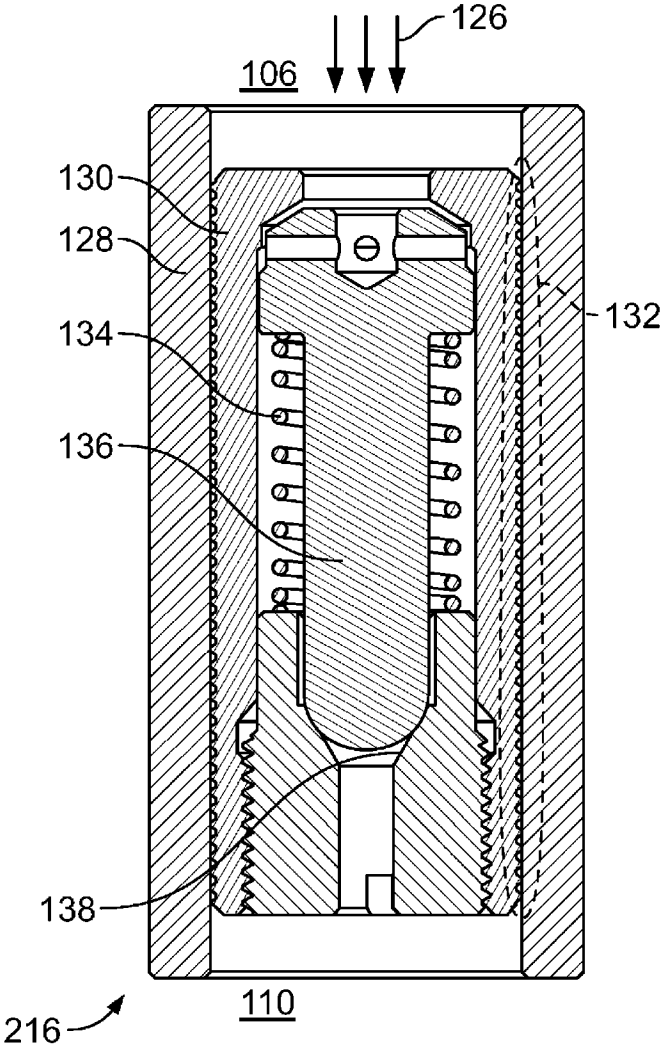

FIGS. 8-9 show cross sectional views of another embodiment of a pressure equalization system, in which a valve 216, such as a safety valve, is disposed in the intermediate pressure side 110 (compression chamber) in fluid communication with the high pressure side 106. FIG. 8 shows valve 216 in a first or closed position, which first or closed position occurring while the compressor is operating, and for a short period of time after the compressor ceases operation. In the closed position of valve 216 (FIG. 8), the end of the portion of the valve poppet 136 adjacent to the high pressure side 106 is in fluid communication with high pressure refrigerant. The product of the pressure from high pressure side 106 and the cross sectional area of the valve poppet 136 in communication with high pressure side 106 defining the amount of force the opposite end of poppet 136 applied to seat 138.

As further shown in FIGS. 8-9, a resilient device 134, such as a spring is compressively interposed between the valve poppet 136 and seat 138 and acts to somewhat reduce the force valve poppet 136 applies to seat 138. Although both the valve poppet 136 and seat 138 may be disposed within second portion 130, neither is so limited. At all times when there is a differential between the high pressure side 106 and the intermediate pressure side 110, the interface 132 between first and second portions 128, 130 of valve 216 permit a flow of refrigerant from the high pressure side 106 to the intermediate pressure side 110. By itself, once compressor operation ceases, the amount of time required for the high and intermediate pressure sides 106, 110 to equalize is significantly high, about ten minutes in one embodiment. As previously discussed, decreasing the rate of flow during operation increases the operating efficiency of the compressor. However, if the time duration required to equalize the high and intermediate pressures 106, 110 is excessive, the compressor may resume operation before the pressures equalize, which is undesirable. The resilient device 134 or spring reduces the amount of time to equalize high and intermediate pressures 106, 110. If the spring or resilient device 134 is installed within valve 216 and sufficiently compressed, the reactive spring force will overcome the reduced pressure forces pressing the valve poppet 136 against seat 138 as shown in FIG. 8. Upon the spring overcoming the reduced pressure forces, the valve poppet 136 is urged away from seat 138 (FIG. 9), permitting much more rapid flow of refrigerant from the high pressure side 106 to the intermediate pressure side 110. That is, FIG. 9 shows valve 216 in a second or open position. In one embodiment, the time duration until the valve poppet 136 is opened is about three minutes. In another embodiment, the time duration until the valve poppet 136 is opened is about five minutes. However, adjustments in spring tension can vary the amount of time required to open the valve poppet 136. For example, in an alternate embodiment, the amount of time required to open the valve poppet 136 is about one minute. That is, by use of spring tension adjustments, the time duration until the valve poppet 136 is opened may range from a fraction of a minute, e.g., 30 seconds or less, to about eight minutes in any combination of minutes or seconds.

Figure 10:
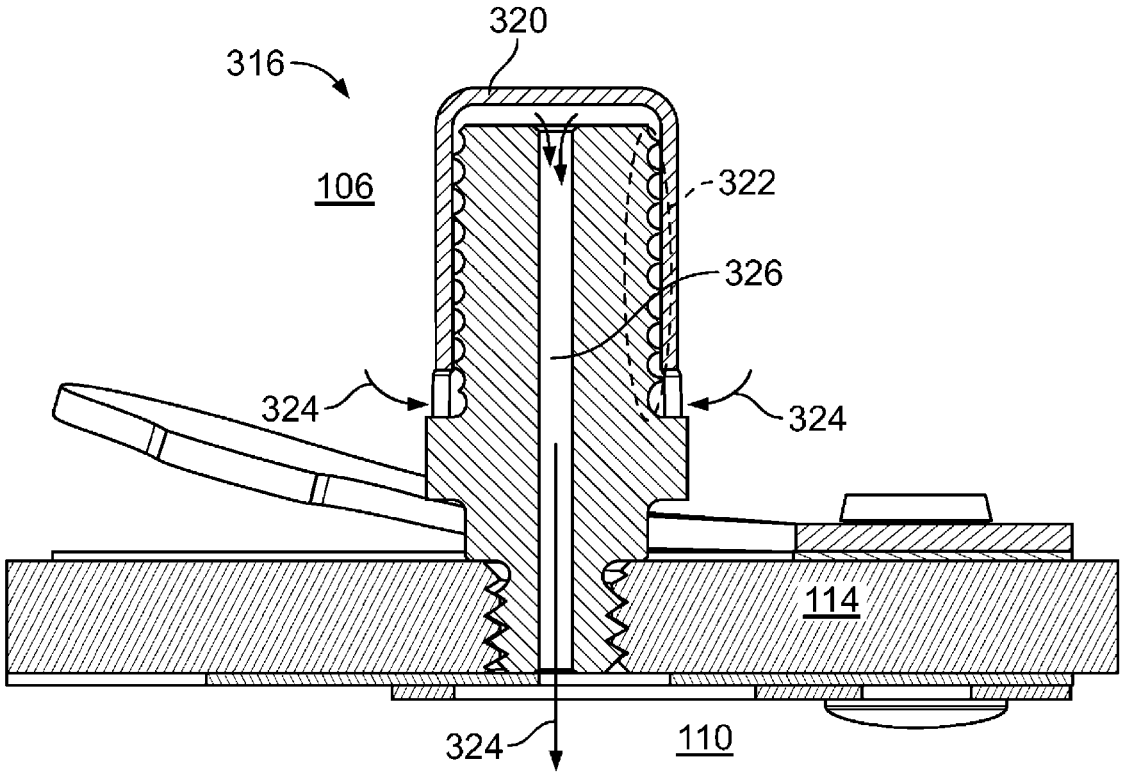
FIG. 10 is a cross-sectional view of a pressure equalization system, including a valve disposed in the high pressure side in fluid communication with the intermediate pressure side (compression chamber).

As shown in FIG. 10, a regulating component, component or valve 316 is disposed in the high pressure side 106 in fluid communication with intermediate pressure side 110 (compression chamber). In another embodiment, valve 316 is disposed in intermediate pressure side 110. Regulating component, component or valve 316 includes a body or valve portion 136 that is secured to valve plate 114 with a number or cap 320 number of that is secured over an end of body or valve portion 136 opposite valve plate 114. Refrigerant in the high pressure side 106 can flow along the interface 322 formed between the body or valve portion 136 and member or cap 320. After flowing past the interface, refrigerant flows through a channel 326 formed in body or valve portion 136 and into the intermediate pressure side 110.

It will be understood by those skilled in the art that various changes may be made and equivalents may be substituted for elements of the application without departing from the scope of the application. In addition, many modifications may be made to adapt a particular situation or material to the teachings of the application without departing from the essential scope thereof.

What is claimed is:

1. A system to equalize pressure in a compressor used to compress a fluid from a low pressure to a high pressure, the system comprising:

a component positioned to provide fluid communication between a high pressure region and a compression chamber of the compressor, the component configured to permit flow of fluid between the high pressure region and the compression chamber at least when the compressor is not in operation.

2. The system of claim 1, wherein the component achieves substantially equal pressures between the high pressure region and the compression chamber in a predetermined amount of time.

3. The system of claim 2, wherein the predetermined amount of time is up to about 10 minutes.

4. The system of claim 2, wherein the predetermined amount of time is between about 30 seconds and about 8 minutes.

5. The system of claim 2, wherein the predetermined amount of time is between about 1 minute and about 5 minutes.

6. The system of claim 2, wherein the predetermined amount of time is about 3 minutes.

7. The system of claim 1, wherein the component is disposed in the high pressure region of the compressor.

8. The system of claim 1, wherein the component is disposed adjacent the compression chamber.

9. The system of claim 1, wherein the component is a tube of predetermined length.

10. The system of claim 9, wherein the tube has a predetermined inside diameter.

11. The system of claim 1, wherein the compression chamber is a cylinder bore of a reciprocating compressor or rotary compressor.

12. The system of claim 10, wherein the tube is a capillary tube, the predetermined length is about 10 inches and the predetermined inside diameter is about 0.02 inch.

13. The system of claim 1, wherein the component comprises:

a body, the body having a channel in fluid communication with the compression chamber;

a cap, the cap being configured and positioned to at least partially enclose the body, the cap having an aperture in fluid communication with the high pressure side; and the body and cap being configured and positioned to provide a passageway for fluid from the aperture to the channel.

14. The system of claim 1, wherein the component includes a valve comprising:

a first portion and a second portion in fluid communication with the high pressure region;

a seat;

a poppet disposed between the second portion and the seat, the poppet positioned in a first position against the seat while the compressor operates, and positioned in a second position against the second portion a predetermined time after the compressor is not in operation;

an interface between the first and second portion providing a controlled flow rate of fluid between the high pressure region and the compression chamber; and wherein upon sufficient flow of fluid through the interface, the poppet is biased in the second position to increase flow of fluid between the high pressure region and the compression chamber.

15. The system of claim 14, wherein the seat is a part of the second portion and the poppet is positioned in a chamber in the second portion.

16. The system of claim 14, wherein a resilient device positions the poppet in the first position.

17. The system of claim 14, wherein the valve is disposed adjacent the compression chamber.

18. The system of claim 14, wherein the valve is disposed in the high pressure region.

19. A system to equalize pressure connected to a compressor comprising:

a body and a member having an interface therebetween, the body and member in fluid communication between a high pressure region and a compression chamber of the compressor; and wherein the body and member are configured to permit flow of fluid between the high pressure region and the compression chamber at least when the compressor is not in operation.

20. The system of claim 19 wherein the body and member are disposed in either the high pressure region or the compression chamber.

* * * * *